US006121877A

United States Patent [19]

Johnson et al.

[11] Patent Number: 6,121,877

[45] Date of Patent: Sep. 19, 2000

[54] BAGGAGE ENTERTAINMENT DEVICES AND METHODS

[76] Inventors: Ingrid H. Johnson; Joey Johnson; Linda H. Johnson, all of 21367 Chirping Sparrow Rd., Diamond Bar, Calif. 91765

[ * ] Notice: This patent issued on a continued prosecution application filed under 37 CFR 1.53(d), and is subject to the twenty year patent term provisions of 35 U.S.C. 154(a)(2).

[21] Appl. No.: 09/224,979

[22] Filed: Jan. 4, 1999

Related U.S. Application Data

[63] Continuation-in-part of application No. 08/950,405, Oct. 15, 1997, abandoned

[60] Provisional application No. 60/055,858, Aug. 15, 1997.

[51] Int. Cl.[7] ..... G08B 13/14

[52] U.S. Cl. ..... 340/571; 340/568.7

[58] Field of Search ..... 340/571, 540, 340/539, 565, 566, 568.7, 309.15, 521; 150/106, 100, 101, 107; 446/397

[56] References Cited

U.S. PATENT DOCUMENTS

| | | | |
|---|---|---|---|
| 4,756,222 | 7/1988 | Armato | 84/600 |
| 4,804,943 | 2/1989 | Soleimani | 340/539 |
| 5,027,106 | 6/1991 | Dailey et al. | 340/571 |
| 5,043,702 | 8/1991 | Kuo | 340/539 |
| 5,123,467 | 6/1992 | Steinberg | 150/106 |
| 5,126,719 | 6/1992 | DeSorbo | 340/571 |
| 5,148,150 | 9/1992 | White et al. | 340/571 |
| 5,304,084 | 4/1994 | Liao | 446/9 |
| 5,464,092 | 11/1995 | Seeley | 206/217 |
| 5,528,228 | 6/1996 | Wilk | 340/686 |
| 5,621,390 | 4/1997 | Neal | 340/584 |
| 5,661,456 | 8/1997 | Staehle, Jr. | 340/571 |
| 5,721,532 | 2/1998 | Lehmann et al. | 340/571 |
| 5,762,194 | 6/1998 | Clegg | 206/449 |
| 5,790,028 | 8/1998 | Lee | 340/571 |
| 5,795,209 | 8/1998 | Moore | 446/73 |
| 5,796,328 | 8/1998 | Golant | 340/571 X |
| 5,955,948 | 9/1999 | Howell | 340/568.7 |

*Primary Examiner*—Daniel J. Wu
*Assistant Examiner*—Sihong Huang
*Attorney, Agent, or Firm*—Fish & Associates; Robert D. Fish

[57] ABSTRACT

A sensor and a response unit are coupled to a piece of baggage to produce an entertaining signal such as music, notes, blinking lights and so forth. The signal may be triggered by any of several events, including proximity, movement, and opening or closing of the baggage, especially at a flap. In preferred embodiments the baggage comprises a sporting or educationally directed personalty holder such as a knapsack.

7 Claims, 1 Drawing Sheet

BAGGAGE ENTERTAINMENT DEVICES AND METHODS

This application is a continuation-in-part of U.S. Pat. No. 08/950405, filed Oct. 15, 1997, now abandoned, which claims priority to provisional application Ser. No. 60/055,858 filed Aug. 15, 1997.

Field of The Invention

The field of the invention is baggage.

BACKGROUND OF THE INVENTION

Personal baggage is generally used to carry clothing, papers, toys and portable items such as personal hygiene devices, toys, tools and so forth. Many different types of personal baggage are known, including formal or casual apparel such as handbags and brief cases, travel containers such as suitcases and garment bags, and sporting or educationally directed items such as knapsacks and school bags. As used herein, the term "knapsack" refers generically to all manners of backpacks, back sacks, rucksacks, hiking bags, day packs and the like.

The known baggage alarms can generally be placed in at least one of three categories. In a first category, it is known to protect personal baggage using an unauthorized entry alarm. Known alarms in this category are generally, or perhaps exclusively, at least partially external to the baggage, and this feature may be intended to provide a visual deterrent against theft. U.S. Pat. No. 5,510,768 to Mann, for example, describes a typical unauthorized entry alarm which relies upon disengagement of an external strap to trigger an audible alarm. In a second category it is known to protect personal baggage with a motion or proximity alarm. U.S. Pat. No. 3,701,140 to Dixon, for example, discloses an alarm which sounds when baggage is pulled from the owner's grasp, and U.S. Pat. No. 5,164,706 to Chen discloses a proximity alarm that sounds when someone or something gets too close to the baggage. Similarly, U.S. Pat. No. 5,434,559 describes an audible or visible alarm which is activated when movement of a protected article is sensed. In a third category, a remote control alarm circuitry is used to protect personal baggage. In U.S. Pat. No. 5,043,702 to Kuo, for example, hand bags, briefcases and other items are provided with a remotely activated alarm which provides both an audible signal, and also a high voltage shock.

Significantly, all of the aforementioned baggage alarms are intended solely to discourage or prevent theft. In fact, the purpose of such alarms is to annoy, alert, and to discourage retention of the baggage while the alarm is sounding.

The present inventors have recognized that the annoying nature of baggage alarms make them unappealing for use in conjunction with sporting or educationally directed baggage such as knapsacks and lunch boxes, especially where such baggage is marketed towards children. Nevertheless, children are prone to losing both their personal items and their knapsacks or other baggage containing such personalty, (from theft or otherwise), and there is a need to combine sporting or educational directed baggage with some sort of alarm.

SUMMARY OF THE INVENTION

The present invention is directed to baggage which produces an entertaining signal such as music, notes, blinking lights and so forth, especially baggage such as knapsacks having a flap-type closure. The signal may be triggered by any of several events, including proximity, movement, opening or opening of the flap. In preferred embodiments operation of the entertaining signal may be at least partially controlled by a remote control.

Various objects, features, aspects and advantages of the present invention will become more apparent from the following detailed description of preferred embodiments of the invention, along with the accompanying drawings in which like numerals represent like components.

DETAILED DESCRIPTION OF THE DRAWING

Figure 1:
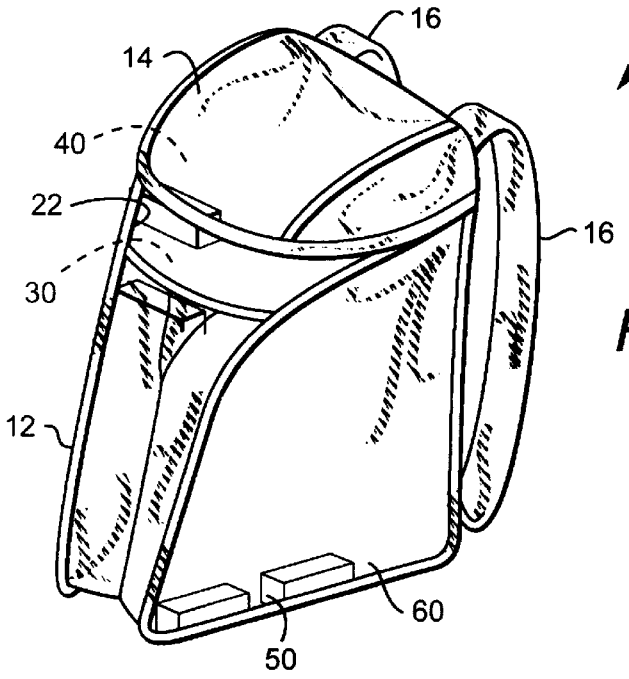
FIG. 1 is a schematic of a knapsack according to the inventive subject matter.

In FIG. 1, a knapsack 10 comprises a body 12, a flap 14, shoulder straps 16, a sensor 50, a response unit 60, and connecting wires (not shown).

There is no particular significance to the design of the knapsack as shown in FIG. 1, and indeed the term knapsack is used herein in its broadest generic sense. Still further, a knapsack is merely one example of a piece of soft baggage having a flap-type closure. Such baggage generally includes backpacks, back sacks, knapsacks, hiking bags, day packs, school bags, belt packs and duffel bags, and many lunch boxes, briefcases, computer cases, camera cases, handbags, suitcases and so forth.

Sensor 50 is intended to sense opening and/or closing of the flap 14. To this end the sensor 50 cooperates with magnetic switch elements 30, 40 positioned on opposite sides of rim 22 to detect opening and closing of the knapsack. When the knapsack is closed, the proximity of the magnets to each other may advantageously produce a signal in the detector circuit, and when the opening is opened, the lack of proximity of the magnets to each other may advantageously produce a different signal in the detector. The magnets in such an embodiment can be sewn into the knapsack, or alternatively they can be removably held within a pocket near the opening, or removably attached using Velcro™ or other adhering means. An electronic circuit for operating the sensor can be similar to that found in the above referenced patents, or can be of another design.

Of course alternative sensors need not be coupled to magnetic switches, and need not necessarily even sense opening and closing. Alternative sensors are contemplated to include motion detectors, proximity detectors and electromagnetic energy detectors that may respond to remote control devices. Thus, events contemplated to be detected by a sensor in the present subject matter include all detectable events, including access (i.e., opening of the baggage), motion, receipt of a remote control signal, temporal events such as the end of a pre-set time span, or occurrence one or more preset times, a temperature change, or a pressure change.

Sensors according to the inventive subject matter can thus comprise anything capable of detecting events, can have any reasonable shape and size, and can be located anywhere in relation to the baggage. Thus, the sensor may be fully, or at least partially hidden from external view. In other aspects, the sensor may be either fixed or removable from the baggage, such that a single sensor can be utilized in different backpacks or other pieces of baggage. In other aspects, the sensor can have an on-off switch and/or a volume control which may be static or which may increase or decrease in volume over time. In yet another aspect the sensor may receive a combination or PIN (personal identification) code which can be used in conjunction with turning on, turning off or opening the baggage.

When the sensor detects an event as discussed above, it triggers the response unit 60 to produce an entertaining signal such as a sound. Preferred entertaining signal comprise a non-threatening sound such as a snippet of music, chimes or bells, a voice, animal sounds, or a beeping sound or pattern such as that heard on a pager or telephone, a smell or a vibration. It is contemplated, for example, to provide the signal by way of an apparatus with means for analog and/or digital recording, such that the owner can modify the sounds produced. It is also contemplated that the entertaining signal can be a visual pattern such as blinking lights, which might include multiple colors.

As the term is used here, an "entertaining signal" means a signal which is sensible to a typical human, but which is unlikely to produce an alarm reaction in such person. Thus, classical music, pop music, or even rap music played at reasonable sound levels, (for example, less than 80 dB) falls within the term "entertaining signal," even though the music may be discordant, disharmonious, cacophonous or otherwise unpleasant to some listeners. Similarly, rhythmic or arrhythmic beeping sounds or blinking lights would generally also fall within the term "entertaining signal." Still further, an "entertaining signal" as the term is used herein includes the "entertainment sound" as defined in U.S. Pat. No. 5,245,666 and U.S. Pat. No. 4,389639, and the "entertaining music" as used in U.S. Pat. No. 4,864,410. By way of further clarification, however, a loud honking, siren or other sound calculated to instill immediate apprehension or other alarm reaction in a typical person would not fall within the term "entertaining signal."

The circuitry for providing an entertaining signal can take any form capable of producing such a signal. Such circuitry is well within the ordinary skill in the art, and includes that found in the above referenced patents as well as any other design. In preferred embodiments, the response circuit is user programmable, so that the user can determine the alarm criteria, and the response or responses that are to be employed in connection with particular circumstances. Thus, movement of the baggage containing the sensor may be programmed to produce a pattern of chimes, while opening of the baggage may produce prerecorded music or sounds from a radio, and the end of a school class period may produce blinking lights. It is also contemplated that the apparatus may be programmed to provide a delay of at least a ½ second between detection of the event and production of the entertaining signal.

In addition to a delay, response unit 60 may advantageously be provided with on-off and volume control functionalities, which may be embodied in switches. Suitable switches are well-known.

In general, both sensor and response circuitry would utilize a local power source. Where a local power source is used, it can include batteries, capacitors or any number of other portable power sources. The local power source is also preferably user replaceable, and may also be rechargeable. In the case of a rechargeable local power source, the circuitry may be coupled to a power cord for use in recharging.

Figure 2:
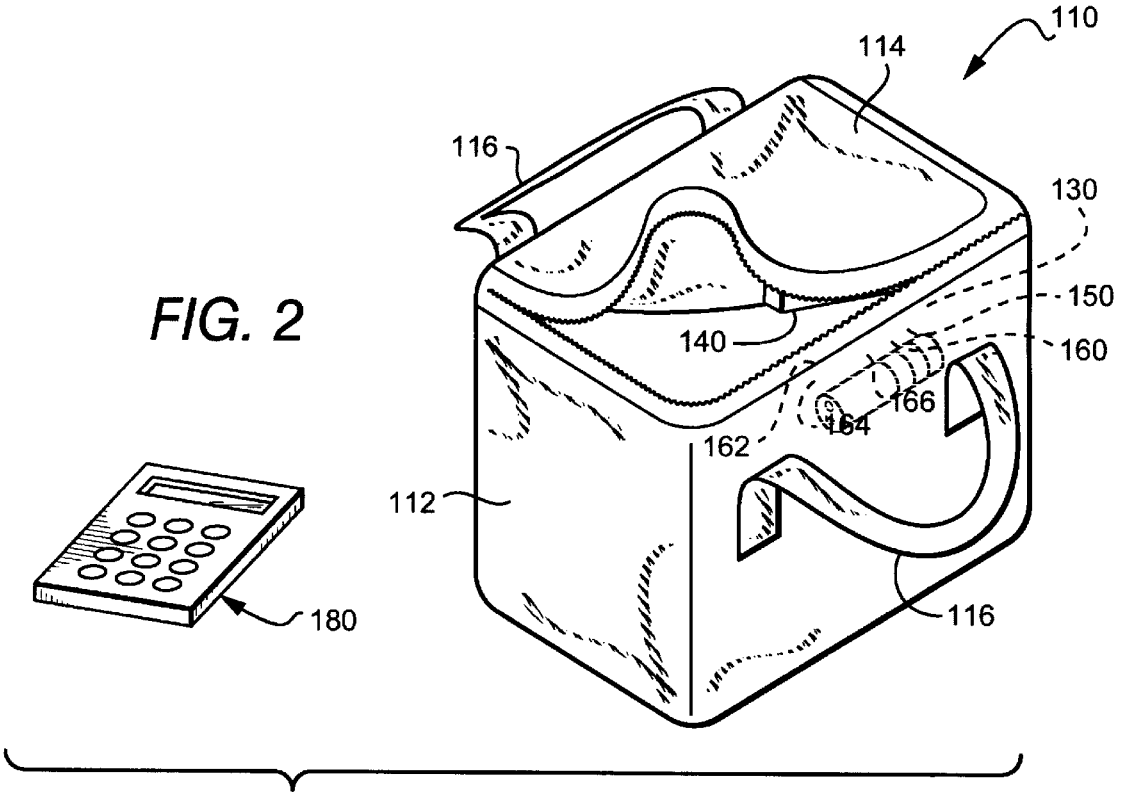
FIG. 2 is a schematic of an alternative embodiment of a piece of baggage according to the inventive subject matter.

In FIG. 2, a food cooler 110 comprises a body 112, a zippered flap 114, and two carrying straps 116. An entertainment device is sewn into, or otherwise coupled to the cooler 110, and includes magnetic elements 140 and 130, a sensor 150, and a response unit 160 having an on-off switch 162, a volume control 164, and a remote control receiver 166.

Although the disclosure relating to magnetic elements 40, 30, sensor 50, and response unit 60 generally apply to magnetic elements 140, 130, sensor 150 and response unit 160, there are several differences. For example, the sensor 150 and the response unit 160 are coupled together in the same physical unit, rather than being embodied separately. In addition, the same unit that houses the sensor 150 and response unit 160 also includes a remote control receiver 166 that cooperates with a remote control transmitter 180. Where remote control is embodied, it is contemplated that any or all of the various functionalities can be remotely controlled, including delay, on-off, and volume control.

Thus, specific embodiments and applications of methods and apparatus for entertaining have been disclosed. It should be apparent, however, to those skilled in the art that many more modifications besides those already described are possible without departing from the inventive concepts herein. For example, both the knapsack and the sensor mechanism can have any other reasonable size, shape, and configuration, relative position and connection. The inventive subject matter, therefore, is not to be restricted except in the spirit of the appended claims.

What is claimed is:

1. A knapsack comprising:

a body defining a cavity, a flap intermittently covering the body, and a plurality of shoulder straps coupled to the body;

the flap including a first sensor responsive to opening of the flap and a second sensor responsive to a second alarm criterion different from opening of the flap; and a programmable response unit through which a user can program an audible entertaining signal in response to the first sensor detecting opening of the flap, and a second, non-audible entertaining signal in response to the second sensor detecting the second alarm criterion.

2. The knapsack of claim 1 wherein the second alarm criterion comprises an occurrence of a temporal event.

3. The knapsack of claim 1 wherein the second alarm criterion comprises a detection of a remote control signal.

4. The knapsack of claim 1 wherein the second entertaining signal comprises a visible signal.

5. The knapsack of claim 1 wherein the second entertaining signal comprises a tactile signal.

6. The knapsack of claim 1 wherein the response unit includes at least one of an on-off functionality, and a volume control functionality.

7. The knapsack of claim 1 wherein the response unit includes a remote control functionality.

* * * * *